United States Patent [19]

Borselli

[11] 4,198,838

[45] Apr. 22, 1980

[54] SUSPENSION DEVICE FOR FASTENING KEYS

[75] Inventor: Massimo Borselli, Florence, Italy

[73] Assignee: Moritz Madler GmbH & Co KG Koffer- und Lederwarenfabrik, Fed. Rep. of Germany

[21] Appl. No.: 944,371

[22] Filed: Sep. 21, 1978

[30] Foreign Application Priority Data

Sep. 22, 1977 [DE] Fed. Rep. of Germany ..... 2742720

[51] Int. Cl.[2] ..... A47G 29/10

[52] U.S. Cl. ..... 70/456 B

[58] Field of Search ..... 70/456 B, 456 R, 457–459; 248/220.2; 150/34, 40; 24/3 K

[56] References Cited

U.S. PATENT DOCUMENTS

| | | | |
|---|---|---|---|
| 1,553,445 | 9/1925 | Holmes | 70/456 B |
| 2,327,433 | 8/1943 | Johnson | 70/456 R |
| 2,348,947 | 5/1944 | Zarouin | 70/456 B |
| 3,469,424 | 9/1969 | Shears | 70/456 B |

*Primary Examiner*—Robert L. Wolfe

*Attorney, Agent, or Firm*—Becker & Becker, Inc.

[57] ABSTRACT

A suspension device for fastening keys onto a carrier member, which comprises a U-shaped holding member connectable to a carrier member and includes two oppositely located legs with two substantially parallel walls defining with each other a longitudinally extending slot. The two legs are interconnected at one end thereof where they define a preferably rounded receiving section wider than the longitudinally extending slot. The device furthermore includes a coupling member detachably connectable to the holding member and having one end provided with a web of substantially rectangular cross section the diagonal of which is shorter than the diameter of the receiving section whereas the narrow sides of the web are shorter and its wider sides are longer than the clear width of the slot, at least the wider sides of the web being inclined relative to the main plane of the coupling member, and the other end of the coupling member being provided with an opening for receiving and holding keys.

6 Claims, 2 Drawing Figures

12
16
13
11
10
II
25
24
26
23
22
20
21
28
18
19
15
17
14
27

SUSPENSION DEVICE FOR FASTENING KEYS

The present invention relates to a suspension for connecting keys to a carrier such as a wall in a suitcase, a briefcase, traveling bag, handbag and the like, which comprises a suspending device connectable to a carrier and furthermore comprising a coupling member connectable to said holding device.

With heretofore known suspension of the type involved, the coupling member consists of a band through which a key or keys can be passed and which at one end thereof has an abutment and on the other end has a threaded pin which is adapted to be screwed into an inner thread provided on said suspension. The suspension has a substantially U-shaped cross section and by means of its legs extends over the wall, whereas the inner thread is provided on the strap and thus extends along an extension of the wall. This heretofore known arrangement has the drawback that it is possible by a strong pull or jerk to tear the coupling member together with the suspension from the carrier wall within the suitcase or bag. The legs of the U-profile therefore do not offer any satisfactory resistance even if they are anchored carefully. On the other hand, the above mentioned known device uses relatively many parts and is expensive while unnecessary time is required to screw the coupling member to the suspension.

It is, therefore, an object of the present invention so to improve the connection between the coupling member and the suspension, and in particular to considerably facilitate the connection of the two parts while nevertheless to make it more difficult to separate these parts from each other so that such separation is possible only by skilled handling.

The suspension according to the present invention is illustrated by way of example in the accompanying drawing, in which.

Figures 1, 2:
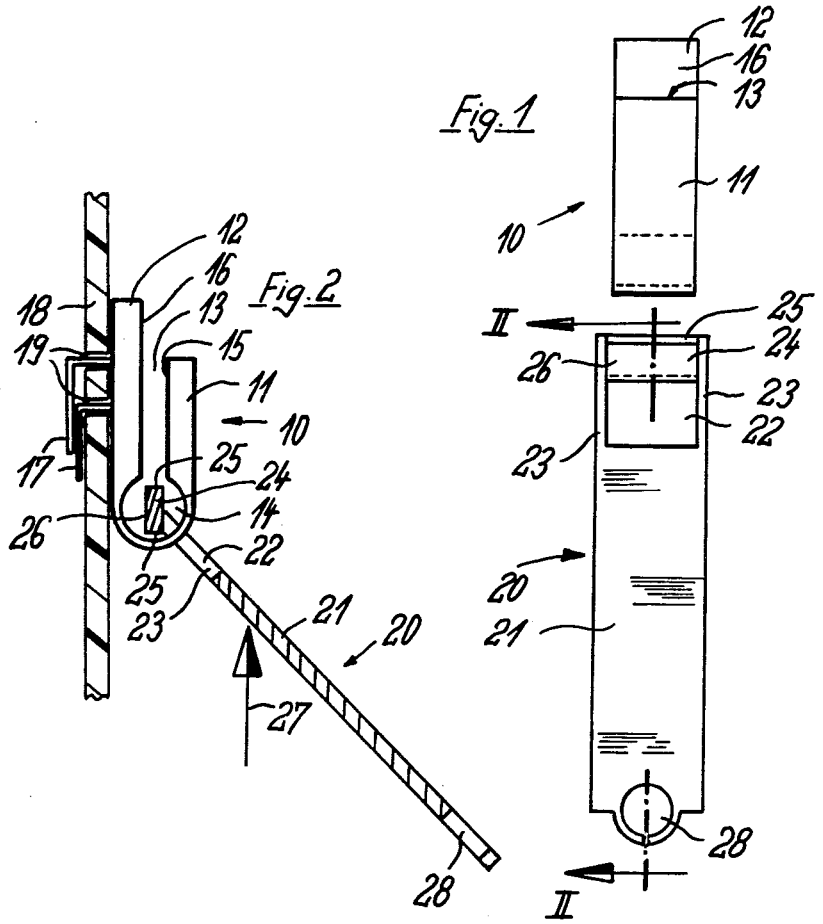
FIG. 1 shows a view of the suspension with the coupling member shown separated from the holding device.
FIG. 2 illustrates a section taken along the line II—II of FIG. 1 with the holding device connected to the suspension.

The suspension device according to the present invention for fastening keys onto a carrier member comprises a U-shaped holding member connectable to a carrier member and including two oppositely located legs with two substantially parallel walls which with each other define a longitudinally extending slot. The two legs are interconnected at one end thereof where they define a preferably rounded receiving section wider than the longitudinally extending slot. The device furthermore includes a coupling member detachably connected to the holding member and having one end provided with a web of substantially rectangular cross section, the diameter of which is shorter than the diameter of the receiving section. The narrow sides of the web are shorter and its wider sides are longer than the clear width of the slot. At least the wider sides of the web are inclined relative to the main plane of the coupling member. The other end of the coupling member is provided with an opening for receiving and holding keys. An arrangement according to the present invention has the advantage that the coupling member with the suspended keys thereon can by a simple movement be inserted into the holding device. The locking of the two parts is obtained by the fact that the keys due to their own weight drop downwardly. The longitudinally extending introducing slot is open at the top so that the web can easily be introduced from the top. When being introduced into the slot, the wide sides of the web of the coupling member slide over the parallel walls until the web has reached the widened portion at the lower end of the legs and the coupling member is freely pivotable. Already after the pivoting of the coupling member by a few degrees, the latter can no longer be accidentally separated from the holding device. In order for purposes of removing the keys to be able to detach the coupling member from the holding device, it is necessary to move the coupling part into a definite inclined position which will then make it possible to withdraw the coupling member without any resistance from the said slot. The owner of the keys or the bag or the suitcase is, of course, thoroughly familiar with this handling movement but for an unskilled person, such removal represents an effective handicap against an unpermitted withdrawal of the keys. Expediently, the connecting elements for the holding device are mounted on the wall of the bag or suitcase laterally on the holding device so that even when, during an unpermitted attempt to withdraw the key or keys, the holding device will slightly tile and thereby make the removal of the key even more difficult.

A further advantage of the invention consists in that the owner of the key or keys has two possibilities to connect the coupling member to the holding device, while each connecting possibility, however, has only one withdrawal possibility associated therewith. A third person, therefore, does not know which removal possibility the owner has selected, so that a short, quick grab will likewise be prevented.

Referring now to the drawing in detail, the holding device 10 has a substantially U-shaped cross section with two legs 11, 12 while the leg 12 in the illustrated embodiment is somewhat longer than the leg 11. Between the legs 11 and 12 there is a longitudinally extending receiving slot 13 with substantially parallel walls 15, 16 which leads to a widening portion 14. The widening portion 14 is substantially cylindrical and with the exception of the merging area to the said slot is closed. The legs 11, 12 have a substantially flat rectangular cross section. The backside of the leg 12 has arranged thereon two tongues 17 located above the widening portion 14. These tongues serve for connecting the holding device 10 to a wall 8 of a bag, suitcase or the like. To this end, perforations 19 may be provided in the wall 18. The connection of the holding device 10 to the carrier wall 18 or to anoher part of the baggage piece can also be effected in a different way.

A coupling member 20 is connectable to the holding device 10. The coupling member 20 primarily consists of a flat plate 21 which at one end is provided with an eye 22 which can be obtained by stamping a rectangular piece out of the flat plate 21. In this way, arms 23 remain between which a web 24 extends. The web 24 has a substantially rectangular cross section with narrow sides 25 and wide sides 26. The narrow sides 25 and the wide sides 26 are so dimensioned that the diagonal cross section of the web 24 is somewhat less than the diameter of the widened portion 14 of the holding device 10. In this way, the coupling member 20 is freely pivotable relative to the holding device 10 when the web 24 is located precisely within the widened portion 14.

According to the illustrated embodiment, the wide sides 26 extend about at an angle of 45° with regard to the main plate or flat plate 21 of the coupling member 20. Therefore, the coupling member 20 must be aligned at said angle with regard to the slot 13 in order to be able to introduce the web 24 into the slot 13 while the wide sides 26 with slight play slide over the walls 15, 16 of the legs 11, 12. By a skilled grip exerted according to arrow 27 upon plate 21 of the coupling member 20, the web 24 can in a simple way be introduced into the slot 13 while the narrow sides 25 are substantially horizontal. The keys suspended in an eye 28 at the other end of plate 21 facilitate this movement. As will be seen from FIG. 2, any other inclination of plate 21 will block the web 24 within the widened portion 14. In particular, when the coupling member 20 is hastily pulled upwardly, the wide sides 26 will be placed before the receiving slot 13 and thus make it impossible to separate the wall member 20 from the holding device 10 and thus from the carrier 18.

It is obvious that the coupling member 20 has to be turned only by 180° about its own axis in order to obtain a different introducing position of the web 24 relative to the slot 13. The relieving position is consequently known only to the rightful owner. The angle of inclination of the wide sides 26 of the web 24 relative to the main plane or plate 21 can be selected at will, so that any number of introducing and withdrawing positions of the coupling member 20 relative to the holding device 10 is obtained. For all of these positions, there are ideally two positions or variations with each suspension. In order to facilitate the introduction of the web 24 into the slot 13, the leg 12 is expediently somewhat longer than the leg 11. Moreover, at the free end of wall 15 of leg 11 there may be provided a bevel.

Due to the fact that the cross section of the eye 22 is only slightly greater than the cross section of the leg 11 on the holding device 10, the eye 22 is able to block the coupling member 20 at the leg 11 of the holding device 10 when the coupling member 20 does not have the prescribed inclination required for withdrawal.

It is, of course, to be understood that the present invention is, by no means, limited to the specific showing in the drawing, but also comprises any modifications within the scope of the appended claims.

What I claim is:

1. A suspension device for fastening keys onto a carrier member, which comprises: a holding member connectable to a carrier member and including two oppositely located legs with two substantially parallel walls defining with each other a longitudinally extending slot, said two legs being interconnected at one end thereof while defining a receiving section wider than said longitudinally extending slot; a coupling member detachably connectable to said holding member and having one end provided with a web of a substantially rectangular cross section the diagonal of which is shorter than the diameter of said receiving section whereas the narrow sides of said web are shorter and its wide sides are longer than the clear width of said slot, at least the wider sides of said web being inclined relative to the main plane of said coupling member, and the other end of said coupling member being provided with means for receiving and holding keys.

2. A suspension device according to claim 1, in which said coupling member forms a flat plate with an eye provided at one end of said plate and laterally defined by two arms, said web being arranged between said arms and being inclined relative to the main plane of said plate.

3. A suspension device according to claim 2, in which the angle of inclination of said web relative to the main plane amounts to about 45°.

4. A suspension device according to claim 1, in which the length of the narrow sides of said rectangular cross section of said web is determined by the thickness of said plate.

5. A suspension device according to claim 1, in which said holding member is substantially U-shaped and has two legs of a flat rectangular cross section.

6. A suspension device according to claim 5, in which the cross section of said eye is only slightly greater than the cross section of said legs.

* * * * *